US010343260B2

(12) United States Patent
Zwier et al.

(10) Patent No.: US 10,343,260 B2
(45) Date of Patent: Jul. 9, 2019

(54) ABRASIVE ARTICLE AND METHOD OF USING THE SAME

(71) Applicant: 3M INNOVATIVE PROPERTIES COMPANY, St. Paul, MN (US)

(72) Inventors: Jacob M. Zwier, River Falls, WI (US); Edward J. Woo, Woodbury, MN (US); Nataliya V. Fedorova, Woodbury, MN (US); Daniel E. Bygd, New Richmond, WI (US); Juan A. Munoz, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/118,278

(22) PCT Filed: Feb. 2, 2015

(86) PCT No.: PCT/US2015/014108
§ 371 (c)(1),
(2) Date: Aug. 11, 2016

(87) PCT Pub. No.: WO2015/123047
PCT Pub. Date: Aug. 20, 2015

(65) Prior Publication Data

US 2016/0354899 A1 Dec. 8, 2016

Related U.S. Application Data

(60) Provisional application No. 61/939,819, filed on Feb. 14, 2014.

(51) Int. Cl.
*B24D 11/00* (2006.01)
*B24D 3/28* (2006.01)

(52) U.S. Cl.
CPC ..... *B24D 3/28* (2013.01); *B24D 11/00* (2013.01)

(58) Field of Classification Search
CPC ..... B24D 3/28; B24D 11/00
(Continued)

(56) References Cited

U.S. PATENT DOCUMENTS 2,958,593 A 11/1960 Hoover
4,018,575 A 4/1977 Davis
(Continued)

FOREIGN PATENT DOCUMENTS

EP 0656080 6/1995
JP S49-47990 U 9/1972
(Continued)

OTHER PUBLICATIONS

Extended European Search Report, EP15748870.1, dated Sep. 18, 2017, 3 pages.
(Continued)

*Primary Examiner* — Robert A Rose
(74) *Attorney, Agent, or Firm* — Katherine M. Scholz; Bradford B. Wright

(57) ABSTRACT

An abrasive article having first and second major surfaces includes a lofty open nonwoven fiber web comprising entangled fibers. The fiber web includes a densified outer layer comprising a portion of nonwoven fiber web proximate to the first major surface. At least a portion the entangled fibers in the densified outer layer are melt-bonded to one another. An abrasive material is coated on the densified outer layer. The abrasive material includes abrasive particles having a median particle diameter D50 in the range of 1 to 15 microns retained in a binder material. The abrasive article
(Continued)

has a Stiffness Test force of 0.1 to 5.0 pounds (0.45 to 2.27 kg) or less. The abrasive article can be used to abrade a workpiece.

12 Claims, 5 Drawing Sheets

(58) Field of Classification Search
USPC ..... 451/526, 533, 534, 536, 28
See application file for complete search history.

(56) References Cited

U.S. PATENT DOCUMENTS

| | | | |
|---|---|---|---|
| 4,078,340 | A | 3/1978 | Klecker |
| 4,142,334 | A | 3/1979 | Kirsch et al. |
| 4,227,350 | A | 10/1980 | Fitzer |
| 4,314,827 | A | 2/1982 | Leitheiser |
| 4,331,453 | A | 5/1982 | Dau |
| 4,518,397 | A | 5/1985 | Leitheiser |
| 4,609,380 | A | 9/1986 | Barnett |
| 4,623,364 | A | 11/1986 | Cottringer |
| 4,652,275 | A | 3/1987 | Bloecher |
| 4,744,802 | A | 5/1988 | Schwabel |
| 4,770,671 | A | 9/1988 | Monroe |
| 4,799,939 | A | 1/1989 | Bloecher |
| 4,881,951 | A | 11/1989 | Wood |
| 4,991,362 | A | 2/1991 | Heyer |
| 5,011,508 | A | 4/1991 | Wald |
| 5,082,720 | A | 1/1992 | Hayes |
| 5,090,968 | A | 2/1992 | Pellow |
| 5,139,978 | A | 8/1992 | Wood |
| 5,178,646 | A | 1/1993 | Barber, Jr. |
| 5,201,916 | A | 4/1993 | Berg |
| 5,227,104 | A | 7/1993 | Bauer |
| 5,366,523 | A | 11/1994 | Rowenhorst |
| 5,378,251 | A | 1/1995 | Culler |
| 5,429,647 | A | 7/1995 | Larmie |
| 5,498,269 | A | 3/1996 | Larmie |
| 5,549,962 | A | 8/1996 | Holmes |
| 5,551,963 | A | 9/1996 | Larmie |
| 5,554,068 | A | 9/1996 | Carr |
| 5,591,239 | A | 1/1997 | Larson |
| 5,681,361 | A | 10/1997 | Sanders, Jr. |
| 5,685,935 | A | 11/1997 | Heyer et al. |
| 5,712,210 | A | 1/1998 | Windisch |
| 5,858,140 | A | 1/1999 | Berger |
| 5,928,070 | A | 7/1999 | Lux |
| 5,942,015 | A | 8/1999 | Culler |
| 6,001,202 | A | 12/1999 | Penttila |
| 6,017,831 | A | 1/2000 | Beardsley |
| 6,183,677 | B1 | 2/2001 | Usui |
| 6,207,246 | B1 | 3/2001 | Moren |
| 6,302,930 | B1 | 10/2001 | Lux |
| 6,312,484 | B1 | 11/2001 | Chou |
| 6,328,773 | B1 | 12/2001 | Beardsley |
| 6,406,504 | B1 | 6/2002 | Lise |
| 7,278,904 | B2 | 10/2007 | Woo |
| 7,517,556 | B2 | 4/2009 | Johnson |
| 7,618,306 | B2 | 11/2009 | Felipe, Sr. |
| 7,628,829 | B2 | 12/2009 | Woo |
| 8,034,137 | B2 | 10/2011 | Erickson |
| 8,123,828 | B2 | 2/2012 | Culler |
| 8,142,531 | B2 | 3/2012 | Adefris |
| 8,142,532 | B2 | 3/2012 | Erickson |
| 9,314,903 | B2 | 4/2016 | Woo |
| 9,370,855 | B2 | 6/2016 | Ohishi |
| 2002/0090901 | A1 | 7/2002 | Schutz |
| 2006/0041065 | A1 | 2/2006 | Barber, Jr. |
| 2007/0066186 | A1 | 3/2007 | Annen |
| 2008/0233850 | A1 | 9/2008 | Woo |
| 2010/0044909 | A1* | 2/2010 | Haskett ..... A47L 13/16 264/175 |
| 2011/0092136 | A1* | 4/2011 | Thysell ..... B24B 7/186 451/28 |
| 2012/0252329 | A1 | 10/2012 | Wald |
| 2013/0130600 | A1 | 5/2013 | Carrozzella |
| 2013/0157544 | A1 | 6/2013 | McArdle et al. |
| 2013/0337725 | A1 | 12/2013 | Monroe |

FOREIGN PATENT DOCUMENTS

| | | | |
|---|---|---|---|
| JP | S51-5115 | Y | 2/1976 |
| JP | S52-165570 | U | 6/1976 |
| JP | S53-489 | A | 1/1978 |
| JP | S54-69890 | A | 6/1979 |
| JP | 2004-511670 | T | 4/2004 |
| JP | 2013-508570 | T2 | 3/2013 |
| JP | 2017-512143 | T | 5/2017 |
| WO | WO 97-42005 | | 11/1997 |
| WO | WO 01-62442 | | 8/2001 |
| WO | WO 02-31245 | | 4/2002 |
| WO | WO 2008-070397 | | 6/2008 |
| WO | WO 2011/049927 | A2 | 4/2011 |
| WO | WO 2012-012940 | | 2/2012 |
| WO | WO 2014-003953 | | 1/2014 |
| WO | WO 2015-123047 | | 8/2015 |

OTHER PUBLICATIONS

International Search Report for PCT International Application No. PCT/US2015/014108, dated May 8, 2015, 4pgs.

* cited by examiner

ABRASIVE ARTICLE AND METHOD OF USING THE SAME

TECHNICAL FIELD

The present disclosure broadly relates to abrasive articles and methods of using them.

BACKGROUND

Consumers have come to expect a glossy, aesthetic exterior finish on new vehicles, such as automobiles and boats. Similar expectations also exist in the aftermarket industry, where vehicles undergo repairs after the exterior of the vehicle has been damaged. Yet achieving a truly aesthetic finish can be daunting. The human eye is extremely keen in its ability to spot even the slightest surface defects, which in turn degrade the finish. Manufacturers and repair shops thus demand rigorous systems and methods capable of removing substantially all surface defects to gain customer acceptance. These systems and methods generally require highly specialized abrasive products used in combination with specialized procedures in order to obtain aesthetically acceptable results.

For example, a typical automotive exterior repair job is a multi-step process involving a series of abrasives having progressively smaller and smaller grain sizes. In a typical procedure, a portion of the panel of an automobile to be repaired is first sanded using a coarse abrasive material that fully removes any pre-existing paint from the metal surface. The surface is then cleaned and coated with a suitable body repair material, such a body filler, putty, epoxy resin, or urethane resin.

Once hardened, the repair material is sanded so that it is flush with the surrounding surface using a progression of abrasives. The sanded area is then coated with a primer layer, typically using a spray gun. After the primer layer is dry, a suitable abrasive is then used to sand the primed surface. The primed surface is then cleaned, and, optionally, surrounding panels are scuffed and a base coat applied with a color that generally matches the rest of the vehicle. A transparent clear coat is then applied over the entire surface of any panels to which base coat was applied. An appropriate abrasive is then used to remove defects such as dirt nibs, dust particles, or excessive orange peel texture. A set of abrasives and/or polishing compounds are then used to remove any sand scratches from the clear coat, and to restore a glossy finish.

A number of foam-backed abrasive products and/or processes are known and have been practiced in the art for achieving a high gloss surface finish; for example, see U.S. Pat. Nos. 6,183,677 (Usui et al.); 6,406,504 (Lise et al.); 7,618,30 (Felipe et al.); and U.S. Pat. Appln. Publ. Nos. 2007/0066186 A1 (Annen et al.) and 2002/0090901 A1 (Schutz et al.).

SUMMARY

The present inventors have unexpectedly discovered that, contrary to general belief among those skilled in the art, a nonwoven abrasive article construction can successfully achieve high gloss finishes, thereby obviating the need for expensive/complicated alternative constructions that are known and used in the art.

Advantageously, abrasive articles according to the present disclosure are capable of generating a similar surface finish to foam products in the market today, and have the potential to be manufactured at lower cost process than corresponding laminated foam-backed abrasive products. Advantageously, abrasive articles according to the present disclosure may exhibit a higher cut rate, longer cut life, and similar surface finish to foam products in the market today.

In one aspect, the present disclosure provides an abrasive article having first and second major surfaces and comprising:

a lofty open nonwoven fiber web comprising entangled fibers, wherein the lofty open nonwoven fiber web further comprises:

a densified outer layer comprising a portion of nonwoven fiber web proximate to the first major surface, wherein at least a portion the entangled fibers in the densified outer layer are melt-bonded to one another; and an abrasive material coated on the densified outer layer, wherein the abrasive material comprises abrasive particles retained in a binder material, and wherein the abrasive particles have a median particle diameter $D_{50}$ in the range of 1 to 15 microns, and wherein the abrasive article has a Stiffness Test force of 0.1 to 5.0 pounds (0.45 to 2.27 kg) or less.

In another aspect, the present disclosure provides a method of buffing a workpiece, the method comprising:

frictionally contacting the first surface an abrasive article according to the present disclosure with a workpiece; and moving at least one of the workpiece and the abrasive article relative to the other to abrade at least a portion of workpiece.

In some embodiments, the workpiece comprises a finish layer disposed on a substrate.

Features and advantages of the present disclosure will be further understood upon consideration of the detailed description as well as the appended claims. Numerical ranges are to be considered inclusive of their endpoints unless clearly indicated to the contrary.

It should be understood that numerous other modifications and embodiments can be devised by those skilled in the art, which fall within the scope and spirit of the principles of the disclosure.

DETAILED DESCRIPTION

Figure 1A:
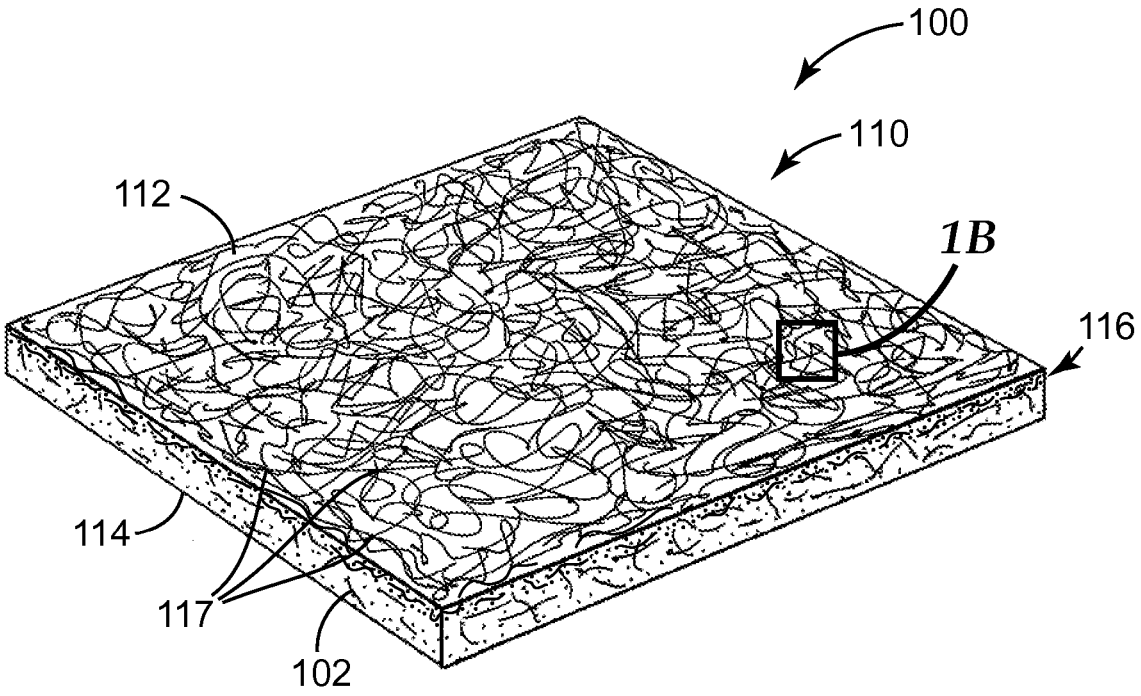
FIG. 1A is a schematic side view of an exemplary abrasive article 100 according to one embodiment of the present disclosure.
Figure 1B:
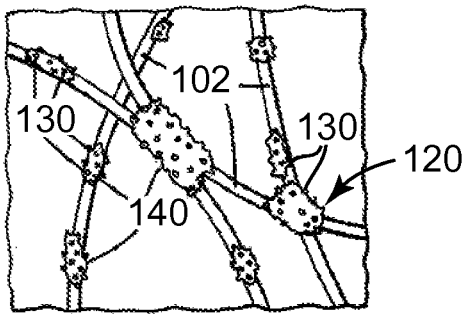
FIG. 1B is an enlarged view of region 1B in FIG. 1A.

Referring now to FIGS. 1A and 1B, abrasive article 100 has first and second opposed major surfaces (112, 114) and comprises lofty open nonwoven fiber web 110. Lofty open nonwoven fiber web 110 comprises entangled fibers 102 and a densified outer layer 116 (i.e., densified relative to the interior of the lofty open fiber web) proximate to first major surface 112. At least a portion of entangled fibers 102 within the densified outer layer 116 are melt-bonded to one another at bonding points 117. Abrasive material 120 is coated on densified outer layer 116. Abrasive material 120 comprises abrasive particles 130 retained in binder material 140. Abrasive particles 130 have a median particle diameter $D_{50}$ in the range of from 1 to 15 microns. Abrasive article 100 has a Stiffness Test (described hereinbelow) force (i.e., the maximum force required to force the test fabric through the opening in the test fixture) of 0.1 to 5.0 pounds (0.45 to 2.27 kg).

Suitable lofty open nonwoven fiber webs (hereinafter, the "nonwoven fiber webs") that are suitable for use in the aforementioned abrasive articles are well known in the abrasives art. Fibers used in the manufacture of the nonwoven fiber web are typically selected to be suitably compatible with adhering binders and abrasive particles while also being processable in combination with other components of the abrasive article, and typically can withstand processing conditions (e.g., temperatures) such as those employed during application and curing of the abrasive material precursor. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers.

Examples of useful synthetic fibers include those made from polyester (e.g., polyethylene terephthalate), nylon (e.g., hexamethylene adipamide, or polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and/or crimped. Combinations of such fibers may also be used. The fibers can be used in the form of a web, a batt, or a tow. As used herein, a "batt" refers to a plurality of air laid webs or similar structures.

An important consideration in the selection of the fiber is that it does not melt or decompose at temperatures at or below the melting or curing temperature of the adhesive used as the fiber and abrasive bonding agent. The fiber used may be virgin fibers or waste fibers reclaimed from garment cuttings, carpet manufacturing, fiber manufacturing, or textile processing, and so forth. The fiber material can be a homogenous fiber or a composite fiber, such as bicomponent fiber (e.g., a co-spun sheath-core fiber). Generally, at least some of the fibers should be selected such that they can be softened or melted sufficiently that bonding can occur between fibers at points where they contact one another, especially in the densified region of the nonwoven fiber web.

The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful.

The fineness or linear density of the fiber used may vary widely, depending upon the results desired. Preferred fine fibers include those having a linear density from about 1 to 25 denier (1.1 to 27.8 dtex), more preferably 4 to 16 denier (4.4 to 17.8 dtex), although finer or coarser fibers may be used depending, for example, on the application envisaged for the finished abrasive article. Preferred coarse fibers include those having a linear density of about 40 to bout 60 denier (4.4 to 70 dtex). Mixtures of fibers (e.g., coarse and fine fibers) with differing linear densities may be useful, for example, to provide an abrasive article that upon use will result in a specifically preferred surface finish. Those skilled in the art will understand that the present disclosure is not limited by the nature of the fibers employed or by their respective lengths, denier, and the like.

The nonwoven fiber web may be made, for example, by conventional air-laid and/or carded, stitch-bonded, spunbonded, and/or melt blown procedures. Air-laid fiber webs may be prepared using equipment such as, for example, that available under the trade designation RANDO WEBBER from Rando Machine Company of Macedon, N.Y. With such processing equipment, fiber length ordinarily should be maintained within about 1.25 cm to about 10 cm. However, with other types of conventional web forming equipment, fibers of different length, or combinations thereof also can be utilized to form the nonwoven fiber webs. The thickness of the fibers is not particularly limited (apart from processing considerations), as long as due regard is given to the resilience and toughness ultimately desired in the resulting web. With the RANDO-WEBBER equipment, fiber thickness is preferably within a range of about 25 to about 250 micrometers. However, in the interest of obtaining a three-dimensional structure with maximum loft and openness, it is preferable that all or a substantial amount of the fibers be crimped. It will be appreciated that crimping may be unnecessary where the fibers readily interlace with one another to form and retain a highly open lofty relationship in the formed web.

It is also contemplated that the nonwoven fiber web may comprise an opened tow of substantially parallel-arranged filaments as the nonwoven flexible abrasive article. In this embodiment, a nonwoven abrasive pad, for example, can be formed by coating an opened tow of filaments with adhesive before or while depositing an abrasive material precursor on the tow.

The nonwoven fiber web is preferably reinforced, for example, using a prebond resin (e.g., a phenolic, urethane, or acrylic resin), by including core-sheath melty fibers, and/or by mechanical entanglement (e.g., hydroentanglement, or needletacking) using methods well-known in the art. Such reinforcement can be imparted to the web, preferably as a separate treatment before the abrasive material is secured to the nonwoven fiber web. A curable prebond resin, which is generally devoid of abrasive components, may be used to reinforce the nonwoven fiber web.

The prebond resin serves, for example, to help maintain the nonwoven fiber web integrity during handling, and may also facilitate bonding of the urethane binder to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of prebond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing. Various other optional conventional treatments and additives may be used in conjunction with the nonwoven fiber web such as, for example, application of antistatic agents, lubricants, or corona treatment.

The curable prebond resin is generally applied to the fibers of the nonwoven fiber web as a liquid coating using known coating or spraying techniques followed by curing/hardening of the prebond resin (e.g., by heat curing), thereby bonding the fibers of the web to one another at their mutual contact points. Suitable adhesive materials that can be used in this regard are known and include those described in U.S. Pat. No. 2,958,593 (Hoover et al.). Where melt-bondable fibers are included within the construction of the nonwoven fiber web, the fibers may be adhered to one another at their mutual contact points by an appropriate heat treatment of the web to melt at least one of the components of the fiber. The melted component performs the function of an adhesive so that, upon cooling, the melted component will re-solidify and thereby form bonds at the mutual contact points of the fibers of the web. The inclusion of melt-bondable fibers (such as those described in U.S. Pat. No. 5,082,720 (Hayes)) in a nonwoven fiber web may or may not be accompanied by the application of a prebond resin, as known by those skilled in the art. The selection and use of melt-bondable fibers, the selection and application of a prebond resin and the conditions required for bonding the fibers of a nonwoven to one another (e.g., by melt-bonding or by prebond resin) are typically within the skill of those practicing in the field.

As mentioned above, the fibers may be bonded together at their mutual contact points (at least in the densified region) to provide the nonwoven fiber web where the interstices between fibers are left substantially unfilled by resin or abrasive. For typical applications, the void volume of the finished abrasive article preferably is in the range of about 75 volume percent to about 95 volume percent. At lower void volumes, there may be a greater tendency to clog-up which reduces the abrasion rate and hinders cleaning of the nonwoven fiber web by flushing. If the void volume is too high, the nonwoven fiber web may lack adequate structural strength to withstand the stresses associated with cleaning or scouring operations.

The nonwoven fiber web may optionally incorporate, or be secured to, a scrim and/or backing (e.g., using glue or a hot-melt adhesive or by needletacking), if desired, for additional reinforcement.

Prior to coating with the abrasive material precursor, the nonwoven fiber web preferably has a weight per unit area (i.e., basis weight) of about 20 grams per square meter (gsm) to about 100 gsm, preferably about 30 gsm to about 90 gsm, and more preferably about 40 gsm to about 80 gsm, as measured prior to any coating (e.g., with the curable composition or optional pre-bond resin), although greater and lesser basis weights may also be used. In addition, prior to coating with the abrasive material precursor, the fiber web typically has a thickness of about 2 millimeters (mm) to about 20 mm, preferably 3 mm to about 15 mm, more preferably about 4 mm to about 9 mm, although greater and lesser thicknesses may also be used.

At least one major surface of the nonwoven fiber web, preferably only one major surface, or the nonwoven fiber web is characterized by a densified region proximate one or both of its two opposed major surfaces (e.g., top and bottom surfaces). In the densified region, the fiber density is higher than in adjacent inner regions of the nonwoven fiber web. The densified region(s) can be formed by any suitable method, which will be known to those of ordinary skill in the art. Examples of methods include mechanical methods (for example, needletacking or hydroentanglement and heating methods (e.g., using one or more of a heated calender roll, hot can, heat gun, impingement oven, or radiant heater). Preferably the heat treatment also is effective for smoothing the surface of the nonwoven fiber web. Accordingly, in preferred embodiments, the densified region(s) of the fiber web have a smoother and/or flatter surface than is present in the nonwoven fiber web before forming the densified region.

Further details concerning suitable fiber webs and methods for their manufacture may be found, for example, in U.S. Pat. Nos. 6,207,246 (Moren et al.); 5,591,239 (Larson et al.); 4,227,350 (Fitzer); and 2,958,593 (Hoover et al.).

As is described in more detail below, the abrasive material is formed through deposition of an abrasive material precursor, containing a binder material precursor material and abrasive particles, onto the densified region of the nonwoven fiber web. When cured, the binder material precursor material is converted into the binder material, which provides sufficient adhesion to strongly bond the abrasive particles to the fibers. The abrasive material precursor is applied to the densified region of the nonwoven fiber web, preferably solely to the densified region, although this is not a requirement. The abrasive material precursor is preferably applied as a continuous layer across the fibers at the first major surface of the abrasive article, although the layer may be discontinuous, if desired. Although the abrasive material precursor layer is preferably continuous (as well as the resultant abrasive material after curing), it will have openings therein corresponding to regions without fibers.

The abrasive material is generally formed by curing the binder material precursor component of an abrasive material precursor after it is applied to the nonwoven fiber web, and optionally at least partially dried.

Useful binder material precursors may comprise a monomeric or polymeric material that may cured (e.g., polymerized and/or crosslinked). Typically, upon curing, such binder material precursors form a non-elastomeric binder material (e.g., a hard brittle binder material) that bonds abrasive particles to the nonwoven fiber web. The binder material may have a Knoop hardness number (KHN, expressed in kilograms-force per millimeter (kgf/mm)) of, for example, at least about 20 kgf/mm, at least about 40 kgf/mm, at least about 60 kgf/mm, or at least about 80 kgf/mm.

Suitable binder material precursors may include condensation-curable materials and/or addition-polymerizable materials. Such binder material precursors may be solvent-based, water-based, or 100 percent solids. Exemplary binder material precursors include phenolic resins, bismaleimides, vinyl ethers, aminoplasts, urethane prepolymers, epoxy resins, acrylates, acrylated isocyanurates, urea-formaldehyde resins, isocyanurates, acrylated urethanes, acrylated epoxies, or mixtures of any of the foregoing. Phenolic resins and epoxy resins, and combinations thereof, are among preferred binder material precursors due to their high performance, wide availability, and low cost.

Exemplary phenolic resins suitable for use in binder material precursors include resole phenolic resins and novolac phenolic resins. Exemplary commercially available phenolic materials include those having the trade designations "DUREZ" or "VARCUM" (available from Durez Corporation, Novi, Mich.); "AROFENE" or "AROTAP" (available from Ashland Chemical Company, Columbus, Ohio); and "BAKELITE" (available from Momentive Specialty Chemicals, Columbus, Ohio). Further details concerning suitable phenolic resins may be found, for example, in U.S. Pat. Nos. 5,591,239 (Larson et al.) and 5,178,646 (Barber, Jr. et al.).

Exemplary epoxy resins include the diglycidyl ether of bisphenol A, as well as materials that are commercially available under the trade designation "EPON" (e.g., EPON 828, EPON 1004, and EPON 1001F) from Momentive Specialty Chemicals; and under the trade designations "D.E.R." (e.g., D.E.R. 331, D.E.R. 332, and D.E.R. 334) or "D.E.N." (e.g., D.E.N. 431 and D.E.N. 428) from Dow Chemical Company, Midland, Mich.

Exemplary urea-formaldehyde resins and melamine-formaldehyde resins include those commercially available as UFORMITE from Cytec Technology Corporation, Wilmington Del.; as DURITE from Momentive Specialty Chemicals; and as RESIMENE from INEOS Melamines GmbH, Frankfort, Germany.

Examples of useful urethane prepolymers include polyisocyanates and blocked versions thereof. Typically, blocked polyisocyanates are substantially unreactive to isocyanate reactive compounds (e.g., amines, alcohols, thiols, etc.) under ambient conditions (e.g., temperatures in a range of from about 20° C. to about 25° C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, and water); adducts of the foregoing polyisocyanates (e.g., isocyanurates, biurets); and mixtures thereof.

Useful commercially available polyisocyanates include, for example, those available under the trade designations: "ADIPRENE" from Chemtura Corporation, Middlebury, Conn. (e.g., ADIPRENE L 0311, ADIPRENE L 100, ADIPRENE L 167, ADIPRENE L 213, ADIPRENE L 315, ADIPRENE L 680, ADIPRENE LF 1800A, ADIPRENE LF 600D, ADIPRENE LFP 1950A, ADIPRENE LFP 2950A, ADIPRENE LFP 590D, ADIPRENE LW 520, and ADIPRENE PP 1095); "MONDUR" from Bayer Corporation, Pittsburgh, Pa. (e.g., MONDUR 1437, MONDUR MP-095, or MONDUR 448); and "AIRTHANE" and "VERSATHANE" from Air Products and Chemicals, Allentown, Pa. (e.g., AIRTHANE APC-504, AIRTHANE PST-95A, AIRTHANE PST-85A, AIRTHANE PET-91A, AIRTHANE PET-75D, VERSATHANE STE-95A, VERSATHANE STE-P95, VERSATHANE STS-55, VERSATHANE SME-90A, and VERSATHANE MS-90A).

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially-available blocked polyisocyanates include those marketed by Chemtura Corporation as ADIPRENE BL 11, ADIPRENE BL 16, and ADIPRENE BL 31, and blocked polyisocyanates marketed by Baxenden Chemicals, Ltd., Accrington, England under the trade designation "TRIXENE" (e.g., TRIXENE BL 7641, TRIXENE BL 7642, TRIXENE BL 7772, and TRIXENE BL 7774).

Typically, the amount of binder material precursor present in the abrasive material precursor is from 10 to 40 percent by weight, more typically in an amount of from 15 to 30 percent by weight, and even more typically in an amount of from 20 to 25 percent by weight based on the total weight of the abrasive material precursor, although amounts outside of these ranges may also be used.

Suitable amine curatives for urethane prepolymers include aromatic, alkyl-aromatic, or alkyl polyfunctional amines, preferably primary amines. Examples of useful amine curatives include 4,4'-methylenedianiline; polymeric methylene dianilines having a functionality of 2.1 to 4.0 available as CURITHANE 103 from the Dow Chemical Company, and as MDA-85 from Bayer Corporation; 1,5-diamine-2-methylpentane; tris(2-aminoethyl)amine; 3-aminomethyl-3,5,5-trimethylcyclohexylamine (i.e., isophoronediamine), trimethylene glycol di-p-aminobenzoate, bis(o-aminophenylthio)ethane, 4,4'-methylenebis(dimethyl anthranilate), bis(4-amino-3-ethylphenyl)methane (e.g., marketed as KAYAHARD AA by Nippon Kayaku Company, Ltd., Tokyo, Japan), and bis(4-amino-3,5-diethylphenyl) methane (e.g., marketed as LONZACURE M-DEA by Lonza, Ltd., Basel, Switzerland); and mixtures thereof. If desired, polyol(s) may be added to the curable composition, for example, to modify (e.g., to retard) cure rates as required by the intended use.

Optionally, but typically, the binder material precursor further includes one or more catalysts and/or curing agents to initiate and/or accelerate the curing process (e.g., thermal catalyst, hardener, crosslinker, photocatalyst, thermal initiator, and/or photoinitiator) as well as in addition, or alternatively, other known additives such as fillers, thickeners, tougheners, grinding aids, pigments, fibers, tackifiers, lubricants, wetting agents, surfactants, antifoaming agents, dyes, coupling agents, plasticizers, suspending agents, bactericides, fungicides, grinding aids, and antistatic agents. The selection and amounts of appropriate catalysts, curing agents, and other additives is within the capability of one of ordinary skill in the art.

The binder material precursor may include at least one organic solvent (e.g., isopropyl alcohol or methyl ethyl ketone) to facilitate coating onto the nonwoven fiber web, although this is not a requirement.

Exemplary lubricants include metal stearate salts such as lithium stearate and zinc stearate, molybdenum disulfide, and mixtures thereof.

As used herein, the term "grinding aid" refers to a non-abrasive (e.g., having a Mohs hardness of less than 7) particulate material that has a significant effect on the chemical and physical processes of abrading. In general, the addition of a grinding aid increases the useful life of a nonwoven abrasive. Exemplary grinding aids include inorganic and organic materials, include waxes, organic halides (e.g., chlorinated waxes, polyvinyl chloride), halide salts (e.g., sodium chloride, potassium cryolite, cryolite, ammonium cryolite, potassium tetrafluoroborate, sodium tetrafluoroborate, silicon fluorides, potassium chloride, magnesium chloride), metals (e.g., tin, lead, bismuth, cobalt, antimony, cadmium, iron, and titanium and their alloys), sulfur, organic sulfur compounds, metallic sulfides, graphite, and mixtures thereof.

Binder material precursors may typically be cured by exposure to, for example, thermal energy (e.g., by direct heating, induction heating, and/or by exposure to microwave and/or infrared electromagnetic radiation) and/or actinic radiation (e.g., ultraviolet light, visible light, particulate radiation). Exemplary sources of thermal energy include ovens, heated rolls, and infrared lamps.

Suitable methods for applying binder material precursors (whether alone or as a slurry in combination with abrasive particles) are well known in the art of abrasive articles, and include coating methods such as curtain coating, roll coating, spray coating, and the like. Typically, spray coating is an effective and economical method. Exemplary slurry coating techniques are described, for example, in U.S. Pat. Nos. 5,378,251 and 5,942,015 (both to Culler et al.).

Abrasive particles suitable for use in abrasive compositions utilized in practice according to the present disclosure include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof. Desirably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, or mixtures thereof. Examples of sol-gel abrasive particles include those described U.S. Pat. Nos. 4,314,827 (Leitheiser et al.); 4,518,397 (Leitheiser et al.); 4,623,364 (Cottringer et al.); 4,744,802 (Schwabel); 4,770,671 (Monroe et al.); 4,881,951 (Wood et al.); 5,011,508 (Wald et al.); 5,090,968 (Pellow); 5,139,978 (Wood); 5,201,916 (Berg et al.); 5,227,104 (Bauer); 5,366,523 (Rowenhorst et al.); 5,429,647 (Larmie); 5,498,269 (Larmie); and 5,551,963 (Larmie). The abrasive particles may be in the form of, for example, individual particles, agglomerates, composite particles, and mixtures thereof. Exemplary agglomerates and composite particles are described, for example, in U.S. Pat. Nos. 4,652,275 (Bloecher et al.); 4,799,939 (Bloecher et al.); and 5,549,962 (Holmes et al.).

Useful abrasive particles a median particle diameter $D_{50}$ in the range of from 1 to 15 microns, preferably 2 to 12 microns, and more preferably 4 to 10 microns. As used herein, the term D50 is used according to its ordinary meaning in the art and refers to the median particle diameter of a distribution of the particles. Methods of determining $D_{50}$ are well known and may include that described in ASTM test method E2651-13, "Standard Guide for Powder Particle Size Analysis".

Preferably, the abrasive particles conform to an abrasives industry specified nominal grade, although this is not a requirement. Such abrasives industry accepted grading standards include those known as the American National Standards Institute, Inc. (ANSI) standards, Federation of European Producers of Abrasive Products (FEPA) standards, and Japanese Industrial Standard (JIS) standards. Exemplary suitable ANSI grade designations (i.e., specified nominal grades) include ANSI 600, ANSI 800, ANSI 1000, and ANSI 1200. Exemplary suitable FEPA grade designations include FEPA 500, FEPA 600, FEPA 800, FEPA 1000, and FEPA 1200. Exemplary suitable JIS grade designations include JIS 800, JIS 1000, JIS 1500, JIS 2500, JIS 3000, HS 4000, and HS 6000.

Useful abrasive particles may also include shaped ceramic abrasive particles as described in U.S. Pat. Nos. 8,142,532 (Erickson et al.); 8,142,531 (Adefris et al.); 8,123,828 (Culler et al.); and 8,034,137 (Erickson et al.), and crushed versions thereof.

Typically, the coating weight for the abrasive particles (independent of other ingredients in the curable composition) may depend, for example, on the particular binder material precursor used, the process for applying the abrasive particles, and the size of the abrasive particles. For example, the weight of the abrasive particles on the nonwoven fiber web may be from about 10 grams per square meter (gsm) to about 80 gsm, preferably from about 20 gsm to about 60 gsm, and more preferably from 30 to 60 gsm, although other amounts may also be used.

Abrasive articles (e.g., webs and sheets) according to the present disclosure may be manufactured through processes that include common steps. In one preferred method, an abrasive material precursor comprising a binder material precursor material and abrasive particles is deposited onto the nonwoven fiber web, for example, by spraying or roll coating the abrasive material precursor as a slurry. In an alternative method, the binder material precursor material is coated on the nonwoven fiber web, and then abrasive particles are deposited on the binder material precursor material prior to curing.

As an alternative to application as slurry with binder material precursor, abrasive particles may be applied to a nonwoven fiber web having a binder material precursor coated thereon using methods known in the abrasive art for application of such particles. For example, the abrasive particles may be applied by blowing or dropping the particles onto uncured binder material precursor, or by a combination thereof. The abrasive material precursor is preferably applied to the nonwoven fiber web to provide (after drying and curing) an abrasive material add-on weight within the range from about 1 gsm to about 50 gsm, preferably from about 4 gsm to about 25 gsm, although other amounts may also be used. However, the specific add-on weights will depend on several factors such as the nature of the nonwoven fiber web as well as the nature of the resin being used. The determination of appropriate abrasive material precursor add-on weights is well within the skill of those practicing in the field.

Abrasive articles according to the present disclosure are then achieved by at least partially curing the abrasive material precursor, for example, using one or more of the techniques described above.

Further details concerning abrasive articles and methods for their manufacture may be found, for example, in U.S. Pat. Nos. 2,958,593 (Hoover et al.); 4,018,575 (Davis et al.); 4,227,350 (Fitzer); 4,331,453 (Dau et al.); 4,609,380 (Barnett et al.); 4,991,362 (Heyer et al.); 5,554,068 (Carr et al.); 5,712,210 (Windisch et al.)5,591,239 (Larson et al.); 5,681,361 (Sanders); 5,858,140 (Berger et al.); 5,928,070 (Lux); 6,017,831 (Beardsley et al.); 6,207,246 (Moren et al.); and 6,302,930 (Lux); and U.S. Pat. Appln. Publ. 2006/0041065 A1 (Barber, Jr.).

Abrasive articles according to the present disclosure have a Stiffness Test (described hereinbelow) force (i.e., the maximum force required to push the test fabric through the opening of the testing fixture) of 0.1 to 5.0 pounds-force (0.4 to 020 N), preferably 1.0 to 5.0 pounds-force (4.4 to 20 N), and more preferably 2.0 to 5.0 pounds-force (8.9 to 20 N). In some embodiments, Abrasive articles according to the present disclosure have a Stiffness Test force of 2 to 4.5 pounds-force (9.0 to 2.3 kg-force). Greater stiffness associated with Stiffness Test force values in excess of 5.0 pounds-force (020 N) results in insufficient conformability of the abrasive article to conformable to irregular surfaces and may result in undesirable wear patterns. On the other hand, Stiffness Test force values of less than 0.1 lb-force (0.4 N) are typically associated with reduced mechanical durability of the abrasive article.

For use with a rotary tool, abrasive articles may be secured to a hooked backup pad such as, for example, a hooked low profile finishing back up pad available from 3M Company under the trade designation "3M HOOKIT DISC PAD". This may be particularly easy if the major surface of the abrasive article opposite the major surface proximate the abrasive material is essentially free of (or even free of) abrasive material (i.e., including binder and abrasive particles) that may inhibit the fibers from engaging with hooks secured to the backup pad.

Abrasive articles according to the present disclosure may be operated, for example, by hand or in combination with a power tool such as for example, a rotary sander or belt sander. Abrasive articles according to the present disclosure are useful for abrading (including finishing) a workpiece by a method that includes: frictionally contacting the abrasive material (i.e., first surface) first surface an abrasive article according to the present disclosure with a workpiece (e.g., a finish layer disposed on a substrate); and moving at least one of the substrate and the abrasive article relative to the other to abrade at least a portion of the finish layer. For example, the abrasive article may oscillate at the abrading interface during use.

The workpiece can be any of a variety of types of material such as, for example, painted substrates (e.g., having a clear coat, base (color) coat, and/or primer or e-primer), clear coated substrates (e.g., with polyurethane or lacquer), plastics (thermoplastic, thermosetting), reinforced plastics, metal (e.g., carbon steel, brass, copper, mild steel, stainless steel, or titanium) metal alloys, ceramics, glass, wood, wood-like materials, composites, stones (e.g., natural stone and gem stones), stone-like materials, and combinations thereof. The workpiece may be flat or may have a shape or contour associated with it. Examples of common workpieces that may be polished by the abrasive article of the present disclosure include metal or wooden furniture, painted or unpainted metal automotive body parts and accessories (e.g., fenders, rocker panels, side panels, roofs, doors, hoods, and trunks), plastic automotive components (e.g., headlamp covers, tail-lamp covers, other lamp covers, arm rests, instrument panels, and bumpers), flooring (e.g., vinyl, stone, wood, and wood-like materials), counter tops, boats, motorcycles, buses, railroad cars, and airplanes.

During abrading processes it may be desirable to provide a liquid to the surface of the workpiece and/or the abrasive article. The liquid may comprise water, an organic compound, additives such as defoamers, degreasers, liquids, soaps, corrosion inhibitors, and the like, and combinations thereof.

SELECT EMBODIMENTS OF THE PRESENT DISCLOSURE

In a first embodiment, the present disclosure provides an abrasive article having first and second major surfaces and comprising:

a lofty open nonwoven fiber web comprising entangled fibers, wherein the lofty open nonwoven fiber web further comprises:

a densified outer layer comprising a portion of nonwoven fiber web proximate to the first major surface, wherein at least a portion the entangled fibers in the densified outer layer are melt-bonded to one another; and an abrasive material coated on the densified outer layer, wherein the abrasive material comprises abrasive particles retained in a binder material, and wherein the abrasive particles have a median particle diameter $D_{50}$ in the range of 1 to 15 microns, and wherein the abrasive article has a Stiffness Test force of 0.1 to 5.0 pounds (0.45 to 2.27 kg) or less.

In a second embodiment, the present disclosure provides an abrasive article according to the first embodiment, wherein the lofty open nonwoven fiber web is needle-tacked.

In a third embodiment, the present disclosure provides an abrasive article according to the first or second embodiment, wherein a pre-bond resin is disposed on the lofty open nonwoven fiber web substantially throughout its entirety.

In a fourth embodiment, the present disclosure provides an abrasive article according to any one of the first to third embodiments, wherein the second major surface is free of the abrasive material.

In a fifth embodiment, the present disclosure provides an abrasive article according to any one of the first to fourth embodiments, wherein the abrasive article has a basis weight in the range of from 200 to 400 grams per square meter.

In a sixth embodiment, the present disclosure provides an abrasive article according to any one of the first to fifth embodiments, wherein the first major surface is substantially flat.

In a seventh embodiment, the present disclosure provides an abrasive article according to any one of the first to sixth embodiments, wherein the abrasive material is continuous.

In an eighth embodiment, the present disclosure provides an abrasive article according to any one of the first to seventh embodiments, wherein the abrasive particles conform to an abrasives industry specified nominal grade in the range of from JIS 1000 to JIS 6000.

In a ninth embodiment, the present disclosure provides a method of buffing a workpiece, the method comprising:

frictionally contacting the first surface an abrasive article according to any one of the first to eighth embodiments with a workpiece; and moving at least one of the workpiece and the abrasive article relative to the other to abrade at least a portion of workpiece.

In a tenth embodiment, the present disclosure provides a method of buffing a workpiece according to the ninth embodiment, wherein the workpiece comprises a finish layer disposed on a substrate, and wherein the abrasive article abrades at least a portion of the finish layer.

In an eleventh embodiment, the present disclosure provides a method of buffing a workpiece according to the tenth embodiment, wherein the finish layer comprises at least one of a paint or clearcoat.

In a twelfth embodiment, the present disclosure provides a method of buffing a workpiece according to the tenth or eleventh embodiment, wherein the substrate comprises an automotive body part.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. As used herein the abbreviation "phr" means parts per hundred by weight.

Materials

Table 1 (below) lists materials used in the Examples.

TABLE 1

| | |
|---|---|
| Fiber1 | 15 denier (17 dtex) × 1.57 inches (40 mm) length Nylon 6 fiber obtained from EMS CHEMIE, Austria |
| Fiber2 | 6 denier (6.7 dtex) × 1.50 inches (38.1 mm) length Nylon 66 fiber, C113, Merge 1V197, obtained from INVISTA, Lugoff, South Carolina |
| Fiber3 | 40 denier (44 dtex) × 2.10 inches (53.3 mm) length Nylon 66 fiber produced by traditional means |
| Fiber4 | 15 denier (16.7 dtex) × 1.25 inches (32 mm) length Polyester fiber, TYPE 295, obtained from INVISTA, Lugoff, South Carolina |
| Fiber5 | 4 denier (4.4 dtex) × 2 inches (51 mm) length low melt Polyester fiber, TYPE 4080, obtained from Unitika, Japan |
| Fiber6 | 58 denier (64.4 dtex) × 2.10 inches (53.3 mm) length fiber, a polymer blend of 50 phr of Nylon 6 and 50 phr of Nylon 66 produced by traditional means |
| BL16 | Polyurethane prepolymer, obtained as ADIPRENE BL-16 from Chemtura Group, Middlebury, Connecticut |
| K450 | Aromatic amine curing agent, LAPDX K-450, obtained from Royce International, East Rutherford, New Jersey |
| PMA | Propylene glycol monomethyl ether acetate, DOWANOL PMA 484431, obtained from Sigma Aldrich, St. Louis, Missouri |
| WATER | Tap water |
| PME | Propylene Glycol Monomethyl Ether, from Dow Chemical Corporation, Midland, Michigan |
| GEO | Anti-foam agent, obtained as GEO FM LTX from GEO Specialty Chemicals, Ambler, Pennsylvania |
| SR511 | 75 percent by weight of hydroxyethylethylene urea in water, obtained as SR511 from Sartomer Inc., Exton, Pennsylvania |
| DYNOL | Surfactant, obtained as DYNOL 604 from Air Products and Chemicals Inc., Allentown, Pennsylvania |
| PR | Phenolic resin obtained as PREFERE 80 5077A from Arclin, Roswell, Georgia |
| TERGITOL | Surfactant, obtained as TERGITOL 15-S-5 from Dow Chemical Company, Midland, Michigan |
| SIA | 3-Aminopropyltriethoxysilane, obtained from Gelest Inc. Morrisville, PA, as SIA0610 |
| CABOSIL | Silicon dioxide, obtained as CAB-O-SIL Untreated Fumed Silica, M-5 from Cabot Corp., Cambridge, Massachusetts |
| C2500 | Black silicon carbide mineral, available as C 2500 BLACK SILICON CARBIDE, $D_{50}$ = 5.6 ± 0.5 microns, from Fujimi Corp. of Tualatin, Oregon |
| GC3000 | Green silicon carbide mineral, available as GC 3000 GREEN SILICON CARBIDE, $D_{50}$ = 4.0 ± 0.5 microns, from Fujimi Corp. |
| GC4000 | Green silicon carbide mineral, available as GC 4000 GREEN SILICON CARBIDE, $D_{50}$ = 3.0 ± 0.4 microns from Fujimi Corp. |
| GC6000 | Green silicon carbide mineral, available as GC 6000 GREEN SILICON CARBIDE, $D_{50}$ = 2.0 ± 0.4 microns from Fujimi Corp. |
| PWA5 | White Aluminum Oxide mineral, available as PWA 5 ALUMINUM OXIDE, $D_{50}$ = 4.7 ± 0.4 microns from Fujimi Corp. |

Test Methods

Basis Weight

The basis weight of the nonwoven samples was determined in accordance with ASTM D6242-98 "Standard Test Method for Mass Unit Area of Nonwoven Fabrics". All samples were conditioned at 65±2% relative humidity and 21±1° C. prior to testing. Five (5) specimens having area of 24 $in^2$ (0.015 $m^2$) were cut from each lot and weighed. The web basis weight was determined by dividing the mass of the specimen in grams by specimen area in square meters (gsm).

Thickness

The thickness of nonwoven fiber webs was determined as the distance between the upper and the lower surfaces of the material, measured under a specified pressure, in accordance with ASTM D5729-97 "Standard Test Method for Thickness of Nonwoven Fabrics". A DIGIMATIC indicator (Mitotoyo America, Aurora, Ill.) was used to measure thickness of the webs. The pressure foot for this test had a diameter of 3.5 inches (88.9 mm), and the applied load was 0.5 lbs (226.8 grams). Five (5) specimens were tested from each lot, and the average was reported Testing Fixture A Scale views of Testing Fixture A are shown in detail in FIGS. 5A-5B. Testing fixture A (500) was fabricated from metal. Key dimensions were as follows: α=34°; h=0.563 inch (1.43); d1=1.80 inches (4.57 cm); d2=2.36 inches (5.99); and d3=3.15 inches (8.00 cm).

Stiffness Test

Figure 5A:
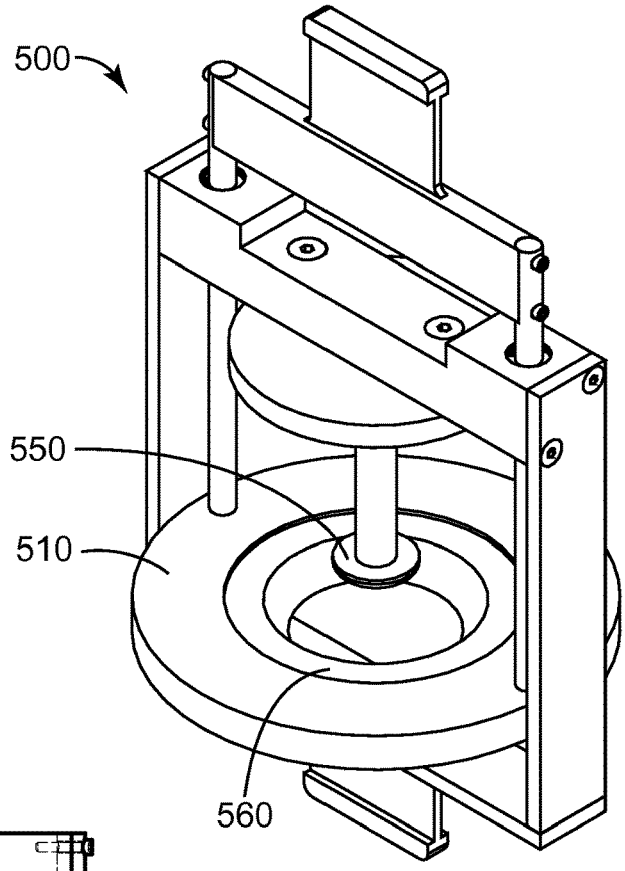
FIG. 5A is a scale schematic perspective view of Testing Fixture A used in the Stiffness Test hereinbelow.
Figure 5B:
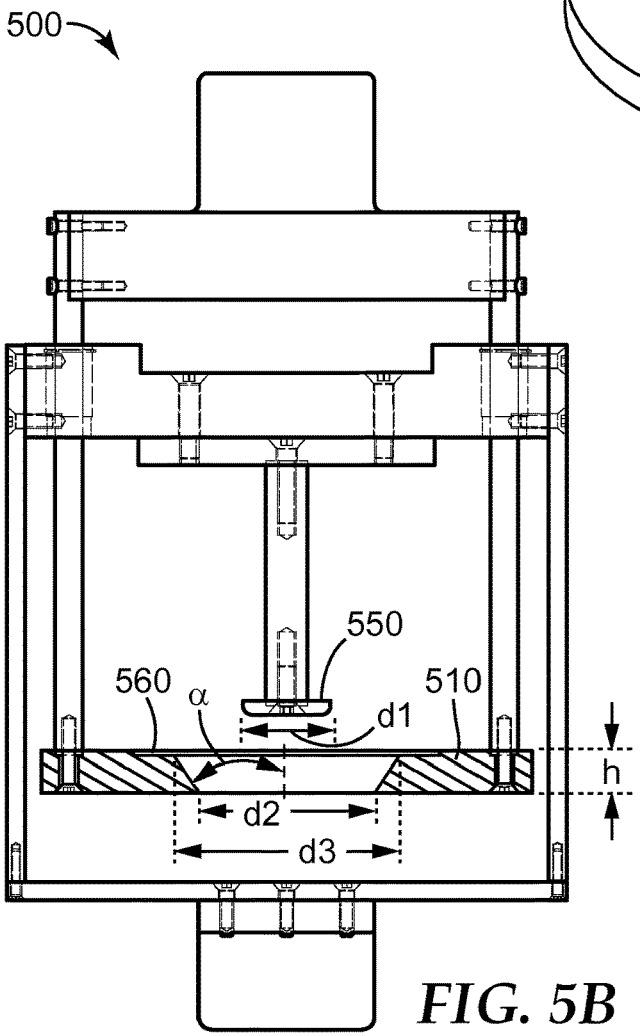
FIG. 5B is a scale schematic partial cross-sectional side view of Testing Fixture A used in the Stiffness Test hereinbelow.

Stiffness of abrasive articles was measured using a Thwing-Albert (Philadelphia, Pa.) ELECTRONIC TENSILE TESTER equipped with a 200-pound (890 N) load cell and pneumatic grips. Referring now to FIGS. 5A and 5B, Testing Fixture A (500) was inserted into pneumatic grips with the bottom grip pulling on the fixture at a speed of 7.8 inch/min (19.8 cm/min) during testing. Four discs with diameters of 4.0 inches (10.2 cm) were cut from each nonwoven abrasive article and placed with abrasive material side up into disc holder 560 in the top side of fixture 510 having a tapered aperture with top diameter d3 of 3.15 inch (8.00 cm) and inner bottom diameter d2 of 2.36 inches (5.99 cm). As the bottom pneumatic grip pulled on the fixture, a 1.8 inch (4.57 cm) diameter circular probe 550 moved downwards until it pushed the 4 inch (10.2 cm) diameter abrasive disc through the tapered aperture. The amount of force in pounds required to push the abrasive disc through the aperture was measured and reported.

Flatness Test Procedure

Test specimens (0.5×12 in (1.27×30.48 cm)) of abrasive article to be evaluated were cut from the original web sample in the cross-web direction using a razor blade. A test specimen was placed between two 0.5×12 in (1.27×30.48 cm) steel bars with the freshly cut edge aligned with the top of both bars to expose a cross-section for microscopic examination of the flatness of each specimen. A confocal microscope with built-in measurement tools (KEYENCE VK9710 from Keyence Corporation, Elmwood Park, N.J.) at 20× magnification was used to measure both high and low deviations of the heat treated side from planarity. A minimum of 6 measurements (microns) were recorded, averaged, and reported in Table 3.

Polishing Test

Procedure I:

The workpieces were 18 in×24 in (46 cm×61 cm) automotive base coat/color coat/clear coat (DuPont RK8148) test panels (obtained from ACT Laboratories, Hillsdale, Mich.).

The test panels were prepared by sanding the entire surface of the panel using a random orbital sander (3M ELITE SERIES 5-IN, NON-VACUUM, 3/32-IN ORBIT, PN: 28498, obtained from 3M, Saint Paul, Minn.) fitted with a low profile finishing disc pad (3M HOOKIT DISC PAD, 5-in×5/16-24 EXT, PN: 77855, from 3M Company) and a P1500 grade abrasive (3M HOOKIT FILM DISC 375L, 5×NH P1500, PN: 55709, from 3M Company). The operating air pressure was maintained at 90 psi (345 KPa). The sanding assembly was placed in contact with the selected test panel section and activated. Beginning in the upper left corner of the panel, the sander was traversed in a left-to-right, right-to-left pattern, indexing down to provide a 50 percent area overlap of each prior pass; and finally in a top-to-bottom, bottom-to-top pattern, indexing right to provide a 50 percent area overlap of each prior pass. The sanding step was repeated until the entire surface was evenly abraded. The sanding residue was removed by wiping with a soft cloth.

Following the preparation step, the imparted scratches were further refined with the inventive and comparative abrasive articles. The test panel was divided into four 6 in×18 in (15 cm×46 cm) sections and each section was abraded with an Example 5 in (12.7 cm) diameter nonwoven abrasive disc, used on the same sander and disc pad as described in the preparation step. The sander was moved forward and back to abrade the selected section. For each section, the total sanding time was 40 seconds. The sanding residue was removed by wiping with a soft cloth.

Following sanding, the panel was buffed with an electric buffer (3M ELECTRIC VARIABLE SPEED POLISHER, PN: 28391, obtained from 3M Company), fitted with a pad adapter (3M QUICK CONNECT ADAPTER, PN: 05750, obtained from 3M Company), an 8" polishing pad (3M PERFECT-IT FOAM COMPOUNDING PAD, PN: 05706, obtained from 3M Company), and a compound (3M PERFECT-IT RUBBING COMPOUND, PN: 39060/pint, obtained from 3M Company). The buffing pad was conditioned by applying a thin, even coating of compound. Compound was applied to the test area to be buffed and distributed using the face of the mounted buffing pad. The buffer was placed in contact with the test area and activated. The buffer was operated in the same pattern as described in the preparation step. Residual compound was removed by wiping with a soft cloth.

Following buffing, the panel was polished using the same buffer, adapter, and method as described in the compounding step. Polishing was completed using an 8-inch diameter polishing pad (3M PERFECT-IT FOAM POLISHING PAD, PN: 05707, obtained from 3M Company) and machined polish (3M PERFECT-IT MACHINE POLISH, PN: 39061, obtained from 3M Company). Each test area was inspected for "wild" scratches and leveling characteristics (reduction of orange peel) in the test area of the panel. Examples passed the buffing test if the orange peel was leveled and there were very few, preferably no scratches remaining on the test panel.

Procedure II

This procedure was identical to Procedure I, except that a 3M HOOKIT FINISHING FILM DISC, 260L, 6 inch, P1500 grit (PN: 00950), was substituted for the 375L disc.

Abrasive Article Preparation

Example 1

An air-laid lofty nonwoven fiber web was prepared from a fiber blend consisting of 50 phr of Fiber1, 25 phr of Fiber2, and 25 phr of Fiber3 using a RANDO-WEBBER machine, obtained from Rando Machine Corporation of Macedon, N.Y. The web was needle-tacked using traditional barbed needles with a spacing of 25 needles per inch (10 needles per cm) at line speed of 3.4 m/min and stroke speed of 290 strokes/min The needle penetration was 8 mm. The web was then calendered at 218° C. under 45 psi (310 kPa) of pressure. The web was further conveyed to a horizontal two-roll coater, where a prebond resin containing 73.6 phr of PMA, 19.3 phr of BL16, and 7.1 phr of K450 was applied to the fiber web at the dry add-on weight of 26 grains/24 square inches (109 gsm). The coated web was conveyed through a forced-convection oven maintained at between 149 and 163° C. with a residence time of 3 minutes. The resulting prebond-treated lofty fiber web had a nominal basis weight of 77 grains per 24 square inches (323 gsm), and the thickness was 0.257 inches (6.53 mm)

The resultant prebond resin-coated and cured lofty fiber web was then conveyed into a spray booth, which contained spray nozzles that reciprocated perpendicularly to the direction of prebond travel. These spray nozzles were used to spray an abrasive slurry containing 22.21 phr of WATER, 3.70 phr of PME, 0.002 phr of GEO, 1.73 phr of SR511, 0.09 phr of DYNOL, 17.38 phr of PR, 0.87 phr of TERGITOL, 0.19 phr of CABOSIL, and 53.83 phr of GC3000 onto the top side of the web. The wet slurry add-on weight was 20 grains/24 square inches (84 gsm).

The resulting abrasive web was heated in a forced-convection oven set at 177° C. for 2 minutes to cure the abrasive slurry. The final nonwoven abrasive web was about 0.270 inches (6.9 mm) thick and weighed about 95 grains/24 square inches (399 gsm). Discs (5-in (12.7 cm) diameter) were cut from the nonwoven abrasive web for testing. Polishing Test Procedure I was used.

Example 2

Figure 2A:
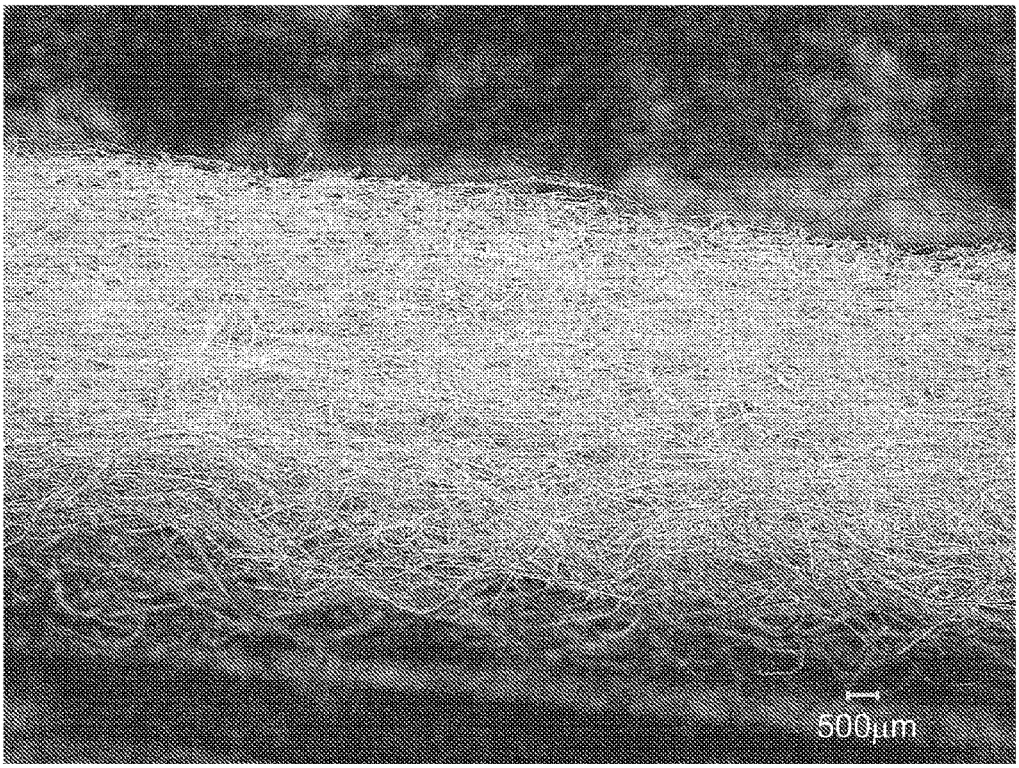
FIG. 2A is a digital micrograph of heat-treated nonwoven fiber web used in Example 2.
Figure 2B:
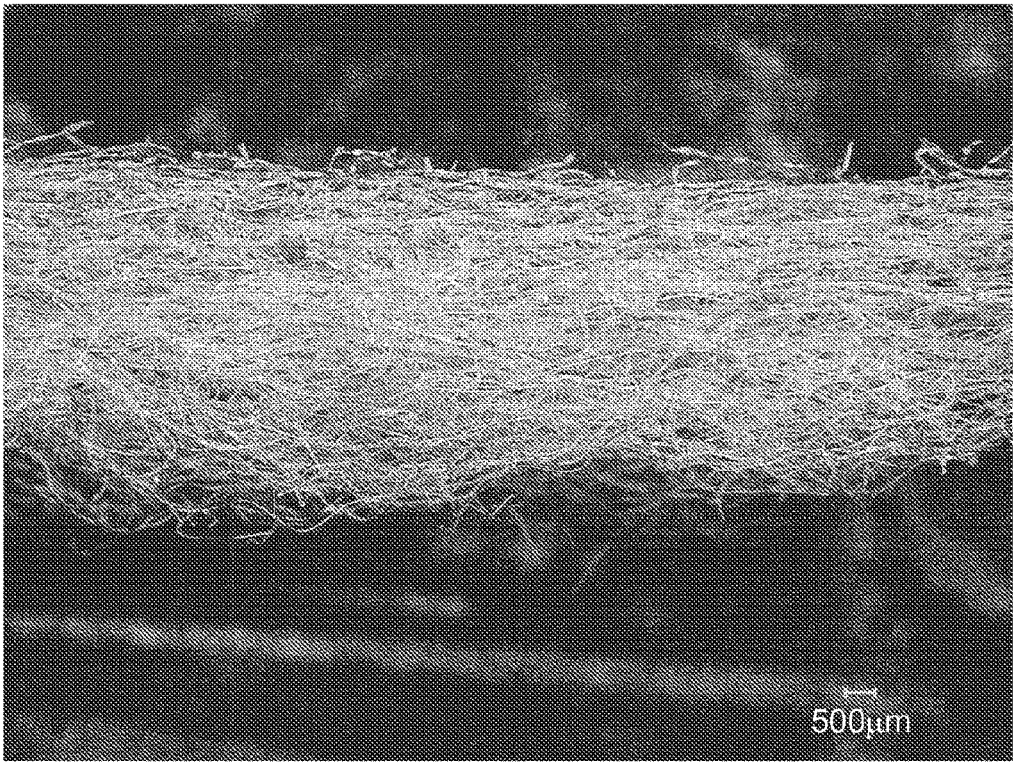
FIG. 2B is a digital micrograph of the abrasive article made in Example 2.

Example 1 was repeated, except for the following changes. The dry prebond resin add-on weight was 7 grains/24 square inches (29 gsm). The resulting prebond resin-coated and cured lofty fiber web had a nominal basis weight of 64 grains/24 square inches (269 gsm), and the thickness was 0.259 inches (6.6 mm) The prebond resin-coated and cured lofty fiber web was sprayed with an abrasive slurry containing 7.0 phr of WATER, 23.5 phr of PME, 0.002 phr of GEO, 1.6 phr of SR511, 0.09 phr of DYNOL, 16.5 phr of PR, 0.9 phr of TERGITOL, 0.40 phr of CABOSIL, 0.9 phr of SIA and 49.0 phr of GC6000. The wet abrasive slurry add on was 23 grains/24 square inches (97 gsm). The final nonwoven abrasive was about 0.282 inches (7.2 mm) thick and weighed about 84 grains/24 square inches (353 gsm). Polishing Test Procedure II was used. FIG. 2A shows the heat-treated nonwoven fiber web (densified layer on upper surface) used in Example 2. FIG. 2B shows the abrasive article (abrasive material on upper surface) made in Example 2.

Example 3

Example 1 was repeated, except for the following changes. The nonwoven fiber web was made using 80 phr of Fiber 4 and 20 phr of Fiber 5. The web was calendered at 166° C. under 45 Psi (310 kPa) of pressure. The web was roll coated using the same prebond resin as Example 1 to achieve a dry add-on weight of 7 grains/24 square inches (29 gsm). The resultant prebond resin-coated and cured lofty fiber web had a nominal basis weight of 63 grains/24 square inches (264 gsm), and the thickness was 0.335 inches (8.5 mm) The wet abrasive slurry add on was 20 grains/24 square inches (84 gsm). The final nonwoven abrasive was about 0.351 inches (8.9 mm) thick and weighed about 76 grains/24 square inches (319 gsm). Polishing Test Procedure I was used.

Example 4

Example 1 was repeated, except for the following changes. The nonwoven fiber web was made using 70 phr Fiber 6 and 30 phr Fiber 2. The web was roll coated using the same prebond resin as Example 1 to achieve a dry add-on weight of 4 grains/24 square inches (17 gsm). The resultant prebond resin-coated and cured lofty fiber web had a nominal basis weight of 71 grains/24 square inches (297 gsm), and the thickness was 0.262 inches (6.7 mm) The wet abrasive slurry add on was 20 grains/24 square inches (84 gsm). The final nonwoven abrasive was about 0.260 inches (6.6 mm) thick and weighed about 80 grains/24 square inches (335 gsm). Polishing Test Procedure I was used.

Example 5

Example 1 was repeated, except for the following changes. The dry prebond resin add-on weight was 5 grains/24 square inches (21 gsm). The resultant prebond resin-coated and cured lofty fiber web had a nominal basis weight of 46 grains/24 square inches (193 gsm), and the thickness was 0.179 inches (4.5 mm) The wet abrasive slurry add on was 16 grains/24 square inches (67 gsm). The final nonwoven abrasive was about 0.181 inches (4.6 mm) thick and weighed about 57 grains/24 square inches (239 gsm). Polishing Test Procedure I was used.

Example 6

Example 1 was repeated, except for the following changes. The dry prebond resin add-on weight was 4 grains/24 square inches (17 gsm). The resultant prebond resin-coated and cured lofty fiber web had a nominal basis weight of 77 grains/24 square inches (323 gsm), and the thickness was 0.297 inches (7.5 mm) The wet abrasive slurry add on was 20 grains/24 square inches (84 gsm). The final nonwoven abrasive was about 0.307 inches (7.8 mm) thick and weighed about 89 grains/24 square inches (374 gsm). Polishing Test Procedure I was used.

Example 7

Example 1 was repeated, except for the following changes. The web was calendered at 207 degrees C.° under 80 Psi (552 kPa) pressure. The web was roll coated using a resin containing 61.0 phr of PMA, 30.0 phr of BL16, and 9 .0 phr of K450 to achieve a dry add-on weight of 18 grains/24 square inches (75 gsm). The resultant prebond resin-coated and cured lofty fiber web had a nominal basis weight of 71 grains/24 square inches (297 gsm), and the thickness was 0.216 inches (5.5 mm) The prebond resin-coated and cured web was sprayed with an abrasive slurry containing 22.21 phr of WATER, 3.70 phr of PME, 0.002 phr of GEO, 1.73 phr of SR511, 0.09 phr of DYNOL, 17.38 phr of PR, 0.87 phr of TERGITOL, 0.19 phr of CABOSIL, and 53.83 phr of C2500. The wet abrasive slurry add on was 15 grains/24 square inches (63 gsm). The final nonwoven abrasive was about 0.242 inches (6.1 mm) thick and weighed about 82 grains/24 square inches (343 gsm). Polishing Test Procedure I was used.

Example 8

Example 1 was repeated, except for the following changes. The dry prebond resin add-on weight was 12 grains/24 square inches (50 gsm). The resulting lofty fiber web had a nominal basis weight of 76 grains/24 square inches (318 gsm), and the thickness was 0.269 inches (6.8 mm) The resultant prebond resin-coated and cured lofty fiber web was sprayed with an abrasive slurry containing 17.40 phr of WATER, 2.90 phr of PME, 0.001 phr of GEO, 1.37 phr of SR511, 0.07 phr of DYNOL, 13.76 phr of PR, 0.69 phr of TERGITOL, 0.15 phr of CABOSIL, and 63.66 phr of PWA5. The wet abrasive slurry add on was 22 grains/24 square inches (92 gsm). The final nonwoven abrasive was about 0.277 inches (7.0 mm) thick and weighed about 92 grains/24 square inches (385 gsm). Polishing Test Procedure I was used.

Example 9

Example 1 was repeated, except for the following changes. The dry prebond resin add-on weight was 6 grains/24 square inches (25 gsm). The resulting lofty fiber web had a nominal basis weight of 61 grains/24 square inches (256 gsm), and the thickness was 0.248 inches (6.3 mm) The resultant prebond resin-coated and cured lofty fiber web was sprayed with an abrasive slurry containing 22.21 phr of WATER, 3.70 phr of PME, 0.002 phr of GEO, 1.73 phr of SR511, 0.09 phr of DYNOL, 17.38 phr of PR, 0.87 phr of TERGITOL, 0.19 phr of CABOSIL, and 53.83 phr of GC4000. The wet abrasive slurry add on was 19 grains/24 square inches (80 gsm). The final nonwoven abrasive was about 0.259 inches (6.6 mm) thick and weighed about 80 grains/24 square inches (336 gsm). Polishing Test Procedure II was used.

Comparative Example A

Example 1 was repeated except for the following changes. The prebond resin-coated fiber web was calendered a second time at 249° C. under 110 Psi (758 kPa) of pressure, and roll coated a second time to achieve a total dry resin add-on weight of 23 grains/24 square inches (97 gsm). The resultant prebond resin-coated and cured lofty fiber web had a nominal basis weight of 83 grains/24 square inches (348 gsm), and the thickness was 0.187 inches (4.7 mm) The resin coated and cured web was sprayed with the abrasive slurry used in Example 1 at 14 fpm (4.3 m/min) The wet abrasive slurry add on was 18 grains/24 square inches (76 gsm). The final nonwoven abrasive was about 0.174 inches (4.4 mm) thick and weighed about 95 grains/24 square inches (399 gsm). Polishing Test Procedure I was used.

Comparative Example B

Figure 3A:
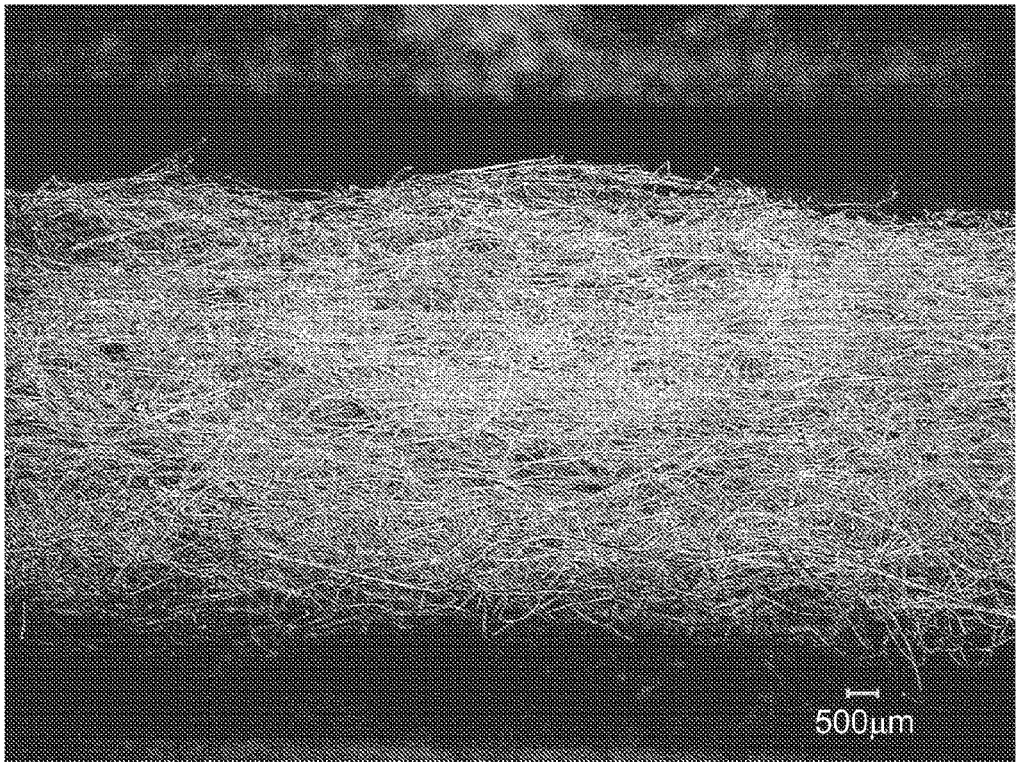
FIG. 3A is a digital micrograph of heat-treated nonwoven fiber web used in Comparative Example B.
Figure 3B:
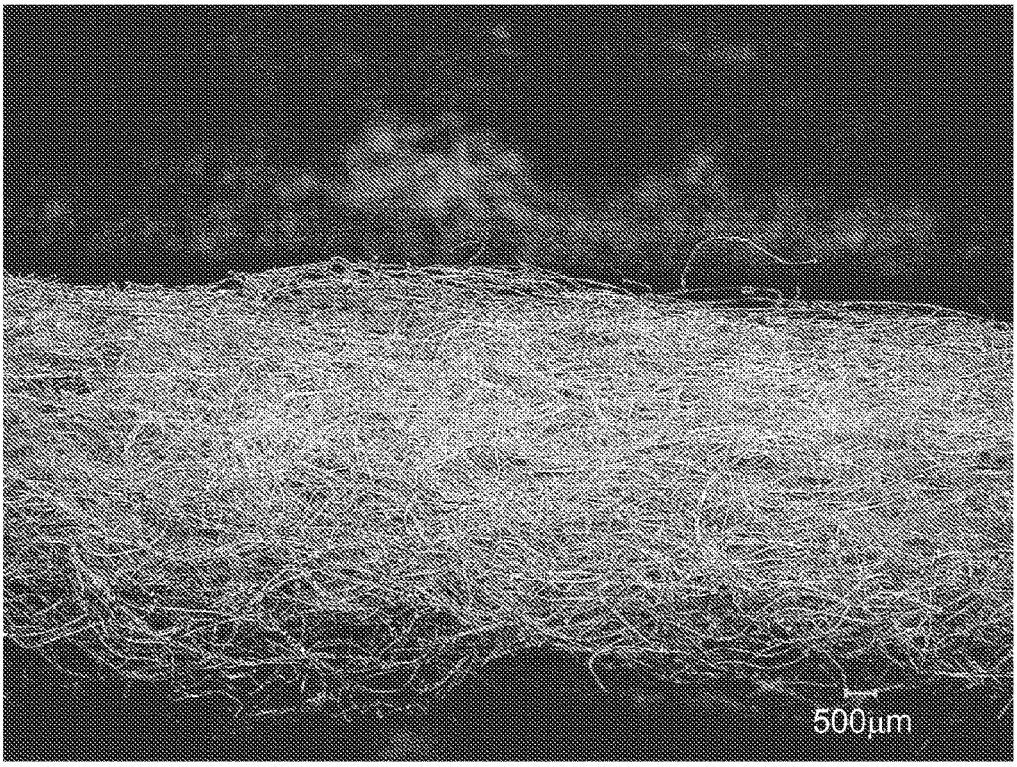
FIG. 3B is a digital micrograph of the abrasive article made in Comparative Example B.

Example 1 was repeated except for the following changes. The web was needle tacked at a stroke speed of 170 strokes/min and the dry prebond resin add-on weight was 17 grains/24 square inches (71 gsm). The resultant prebond resin-coated and cured lofty fiber web had a nominal basis weight of 68 grains/24 square inches (285 gsm), and the thickness was 0.270 inches (6.9 mm) The prebond resin-coated and cured web was sprayed using the same conditions and abrasive slurry used for Example 1. The wet abrasive slurry add on was 18 grains/24 square inches (76 gsm). The final nonwoven abrasive was about 0.256 inches (6.5 mm) thick and weighed about 78 grains/24 square inches (327 gsm). Polishing Test Procedure I was used. FIG. 3A shows the heat-treated nonwoven fiber web (densified layer on upper surface) used in Comparative Example B. FIG. 3B shows the abrasive article (abrasive material on upper surface) made in Comparative Example B.

Comparative Example C

Comparative Example A was repeated, except for the following changes. The prebond resin-coated and cured web was sprayed with the abrasive slurry used in Example 1 at 20 fpm (6.1 m/min) The wet abrasive slurry add on was 18 grains/24 square inches (76 gsm). The final nonwoven abrasive was about 0.188 inches (4.8 mm) thick and weighed about 149 grains/24 square inches (625 gsm). Polishing Test Procedure I was used.

Comparative Example D

Figure 4A:
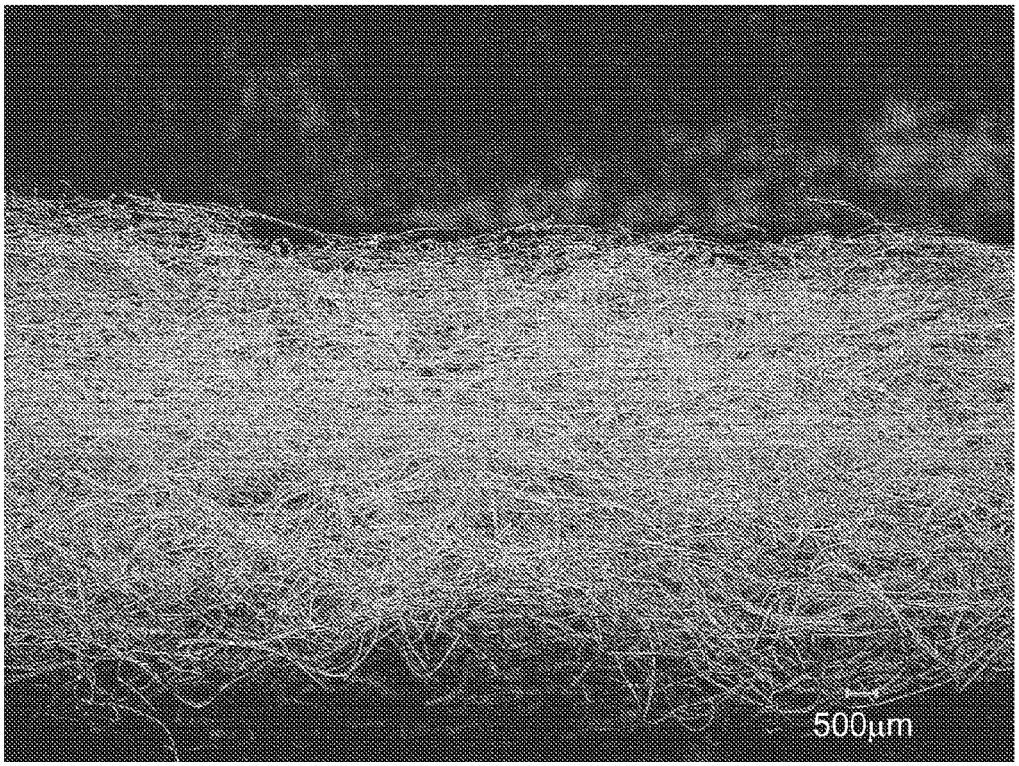
FIG. 4A is a digital micrograph of non-heat-treated nonwoven fiber web used in Comparative Example D.
Figure 4B:
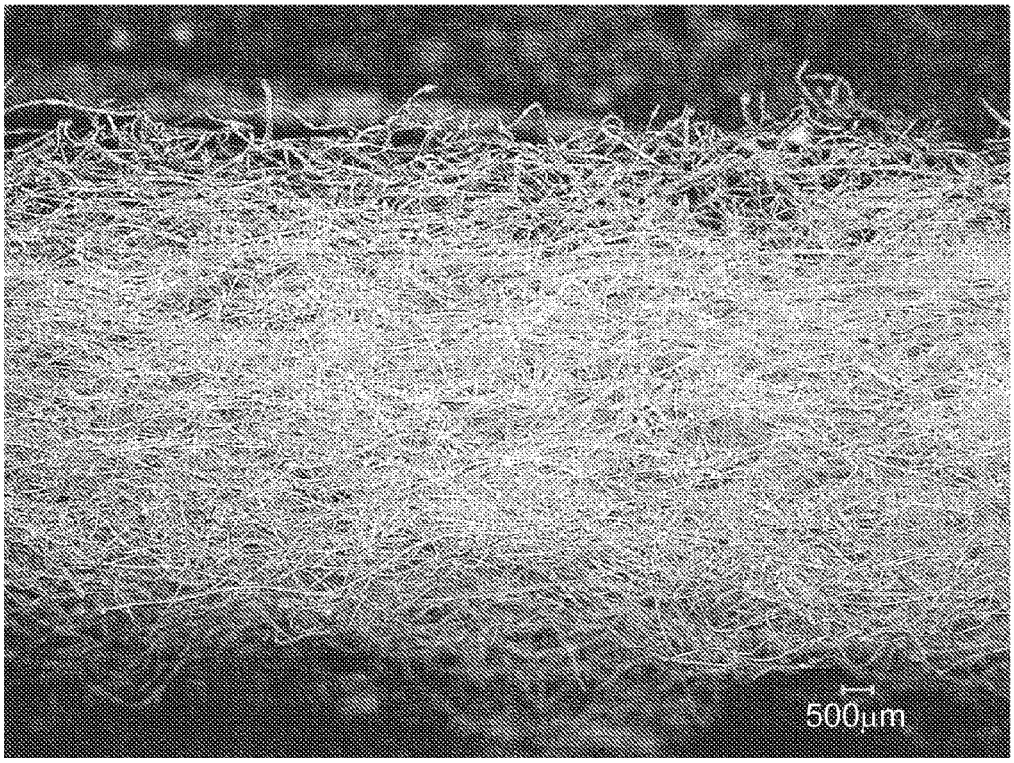
FIG. 4B is a digital micrograph of the abrasive article made in Comparative Example D.

Example 1 was repeated except for the following changes. The web was not heat-treated and dry prebond resin add-on weight was 11 grains/24 square inches (46 gsm). The resultant prebond resin-coated and cured lofty fiber web had a nominal basis weight of 66 grains/24 square inches (277 gsm), and the thickness was 0.398 inches (10.1 mm) The prebond resin-coated and cured web was sprayed with the abrasive slurry used in Example 1 at 20 fpm (6.1 m/min) The wet abrasive slurry add on was 18 grains/24 square inches (76 gsm). The final nonwoven abrasive was about 0.403 inches (10 2 mm) thick and weighed about 80 grains/24 square inches (336 gsm). FIG. 4A shows the non-heat-treated nonwoven fiber web (prebond applied to top surface) used in Comparative Example D. FIG. 4B shows the abrasive article (abrasive material on upper surface) made in Comparative Example D. Polishing Test Procedure I was used.

Comparative Example E

Example 1 was repeated except for the following changes. The dry prebond resin add-on weight was 6 grains/24 square inches (25 gsm). The resultant prebond resin-coated and cured lofty fiber web had a nominal basis weight of 76 grains/24 square inches (319 gsm), and the thickness was 0.352 inches (8.9 mm) The prebond resin-coated and cured web was sprayed with the abrasive slurry used in Example 1 at 20 fpm (6.1 m/min) The wet abrasive slurry add on was 18 grains/24 square inches (76 gsm). The final nonwoven abrasive was about 0.372 inches (9.4 mm) thick and weighed about 96 grains/24 square inches (403 gsm). Polishing Test Procedure I was used.

Test Results

Examples 1 through 9 and Comparative Examples A through C were tested according to the Hand Flex Test and the Polishing Test. The results are reported in Tables 2 and 3, below.

TABLE 2

| | PREBONDED NONWOVEN FIBER WEB | |
|---|---|---|
| EXAMPLE | THICKNESS, in (mm) | BASIS WEIGHT, grains/24 in$^2$ (gsm) |
| 1 | 0.257 (6.5) | 77 (323) |
| 2 | 0.259 (6.6) | 64 (269) |
| 3 | 0.335 (8.5) | 63 (264) |
| 4 | 0.262 (6.7) | 71 (298) |
| 5 | 0.179 (4.5) | 46 (193) |
| 6 | 0.297 (7.5) | 77 (323) |
| 7 | 0.216 (5.5) | 71 (298) |
| 8 | 0.269 (6.8) | 76 (319) |
| 9 | 0.248 (6.3) | 61 (256) |
| Comparative Example A | 0.187 (4.7) | 83 (348) |
| Comparative Example B | 0.270 (6.9) | 68 (285) |
| Comparative Example C | 0.187 (4.7) | 83 (348) |
| Comparative Example D | 0.398 (10.1) | 66 (277) |
| Comparative Example E | 0.352 (8.9) | 76 (319) |

TABLE 3

| | ABRASIVE ARTICLE - FULL CONSTRUCTION | | | | | | |
|---|---|---|---|---|---|---|---|
| | | BASIS WEIGHT, | STIFFNESS TEST, | FLATNESS TEST, microns | | POLISHING | POLISHING TEST |
| EXAMPLE | THICKNESS, in (mm) | grains/24 in$^2$ (gsm) | pound-force (kg-force) | MEAN | STD. DEV. | TEST PROCEDURE | RESULT, Pass (P) or Fail (F) |
| 1 | 0.270 (6.9) | 95 (399) | 4.5 (2.0) | 293 | 62.6 | I | P |
| 2 | 0.282 (7.2) | 84 (353) | 3.3 (1.3) | 329 | 46.0 | II | P |
| 3 | 0.351 (8.9) | 76 (319) | 4.5 (2.0) | 287 | 56.5 | I | P |
| 4 | 0.260 (6.6) | 80 (336) | 1.7 (0.8) | 284 | 36.7 | I | P |

TABLE 3-continued

| | ABRASIVE ARTICLE - FULL CONSTRUCTION | | | | | | |
|---|---|---|---|---|---|---|---|
| | | BASIS WEIGHT, | STIFFNESS TEST, | FLATNESS TEST, microns | | POLISHING | POLISHING TEST |
| EXAMPLE | THICKNESS, in (mm) | grains/24 in$^2$ (gsm) | pound-force (kg-force) | MEAN | STD. DEV. | TEST PROCEDURE | RESULT, Pass (P) or Fail (F) |
| 5 | 0.181 (4.6) | 57 (239) | 1.0 (0.5) | 239 | 57.1 | I | P |
| 6 | 0.307 (7.8) | 89 (374) | 1.8 (0.8) | 304 | 44.0 | I | P |
| 7 | 0.242 (6.1) | 82 (344) | 5.0 (2.3) | 265 | 68.5 | I | P |
| 8 | 0.277 (7.0) | 92 (386) | 3.0 (1.4) | 265 | 57.3 | I | P |
| 9 | 0.259 (6.6) | 80 (336) | 3.6 (1.7) | 296 | 47.1 | II | P |
| Comparative Example A | 0.174 (4.4) | 95 (399) | 6.4 (2.9) | 248 | 27.2 | I | F |
| Comparative Example B | 0.256 (6.5) | 78 (327) | 5.9 (2.7) | 616 | 89.0 | I | F |
| Comparative Example C | 0.188 (4.8) | 149 (625) | 5.5 (2.5) | 531 | 48.4 | I | F |
| Comparative Example D | 0.402 (10.2) | 77 (323) | 3.7 (1.7) | 736 | 86.7 | I | F |
| Comparative Example E | 0.372 (9.4) | 96 (403) | 5.6 (2.5) | 711 | 198.0 | I | F |

All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. An abrasive article having first and second major surfaces and comprising:

a lofty open nonwoven fiber web comprising entangled fibers, wherein the lofty open nonwoven fiber web further comprises:

a densified outer layer comprising a portion of nonwoven fiber web proximate to the first major surface, wherein at least a portion the entangled fibers in the densified outer layer are melt-bonded to one another; and an abrasive material coated on the densified outer layer, wherein the abrasive material comprises abrasive particles retained in a binder material, and wherein the abrasive particles have a median particle diameter $D_{50}$ in the range of 1 to 15 microns, and wherein the abrasive article has a Stiffness Test force of 0.1 to 5.0 pounds (0.45 to 2.27 kg) or less.

2. The abrasive article of claim 1, wherein the lofty open nonwoven fiber web is needle-tacked.

3. The abrasive article of claim 1, wherein a pre-bond resin is disposed on the lofty open nonwoven fiber web substantially throughout its entirety.

4. The abrasive article of claim 1, wherein the second major surface is free of the abrasive material.

5. The abrasive article of claim 1, wherein the abrasive article has a basis weight in the range of from 200 to 400 grams per square meter.

6. The abrasive article of claim 1, wherein the first major surface is substantially flat.

7. The abrasive article of claim 1, wherein the abrasive material is continuous.

8. The abrasive article of claim 1, wherein the abrasive particles conform to an abrasives industry specified nominal grade in the range of from JIS 1000 to JIS 6000.

9. A method of buffing a workpiece, the method comprising:

frictionally contacting the first surface of an abrasive article according to claim 1 with a workpiece; and moving at least one of the workpiece and the abrasive article relative to the other to abrade at least a portion of workpiece.

10. The method of buffing a workpiece of claim 9, wherein the workpiece comprises a finish layer disposed on a substrate, and wherein the abrasive article abrades at least a portion of the finish layer.

11. The method of buffing a workpiece of claim 10, wherein the finish layer comprises at least one of a paint or clearcoat.

12. The method of buffing a workpiece of claim 10, wherein the substrate comprises an automotive body part.

* * * * *